US005676364A

United States Patent [19]

Shiiki et al.

[11] Patent Number: 5,676,364

[45] Date of Patent: Oct. 14, 1997

[54] PLATE MATERIAL SEPARATING APPARATUS

[75] Inventors: Takuma Shiiki; Yasutaka Yamaguchi, both of Kanagawa, Japan

[73] Assignee: Amada Company, Limited, Kanagawa, Japan

[21] Appl. No.: 710,007

[22] Filed: Sep. 11, 1996

Related U.S. Application Data

[62] Division of Ser. No. 293,205, Aug. 19, 1994, Pat. No. 5,622,362.

[51] Int. Cl.[6] ..... B65H 3/40

[52] U.S. Cl. ..... 271/91; 271/106; 271/107

[58] Field of Search ..... 271/91, 92, 105, 271/106, 107; 414/797

[56] References Cited

U.S. PATENT DOCUMENTS

| | | | |
|---|---|---|---|
| 2,941,799 | 6/1960 | Reinecke . | |
| 5,048,811 | 9/1991 | Hochbein | 271/106 X |
| 5,234,207 | 8/1993 | Lindstrom et al. | 271/106 X |
| 5,352,086 | 10/1994 | Mank . | |

FOREIGN PATENT DOCUMENTS

| | | | |
|---|---|---|---|
| 2452052 | 5/1976 | Germany . | |
| 2725831 | 2/1979 | Germany . | |
| 3424814 | 3/1985 | Germany . | |
| 3609549 | 10/1987 | Germany . | |
| 4002368 | 6/1991 | Germany . | |
| 61-136838 | 6/1986 | Japan | 271/106 |
| 62-16430 | 4/1987 | Japan . | |
| 3-23132 | 3/1991 | Japan . | |
| 3238244 | 10/1991 | Japan | 271/106 |
| 432422 | 2/1992 | Japan | 271/106 |
| 6179535 | 6/1994 | Japan | 271/91 |
| 1531509 | 11/1978 | United Kingdom . | |
| 1547776 | 6/1979 | United Kingdom . | |

*Primary Examiner*—David H. Bollinger

*Attorney, Agent, or Firm*—Wigman, Cohen, Leitner & Myers, P.C.

[57] ABSTRACT

A plate material separating apparatus comprises: a horizontal beam (9) movable up and down; a plurality of vacuum hanger members (11) fixedly arranged at regular intervals on both sides of the horizontal beam so as to extend horizontally; a plurality of support vacuum pad devices (13B, 13C) attached to each of the vacuum hanger members at regular intervals in a direction perpendicular to an end surface of a plate material (W); a plurality of pivotal take-up vacuum pad devices (13A) each attached to an end of each of the vacuum hanger members so as to be located near the end surface of the plate material; and a plurality of driving devices (37) each associated with each of the pivotal take-up vacuum pad devices, for pivoting the pivotal take-up vacuum pad device to bend the plate material only at and along the end surface thereof so that air can be introduced between an uppermost plate material and a second plate material, thus allowing the plate material to be separated easily from the stacked materials.

2 Claims, 17 Drawing Sheets

PLATE MATERIAL SEPARATING APPARATUS

This is a divisional of application Ser. No. 08/293,205, filed Aug. 19, 1994, now U.S. Pat. No. 5,622,362.

BACKGROUND OF THE INVENTION

1. Field of the Invention

The present invention relates to a plate material separating apparatus, and more specifically to an apparatus for separating only an uppermost plate material from stacked plate materials to feed only a single separated plate to a plate material processing machine such as turret punch press, for instance.

2. Description of the Related Art

In the conventional plate material separating apparatus, a plurality of vacuum pads are arranged on each of a plurality of vacuum hangers fixedly arranged at regular intervals on both sides of the horizontal beam, in such a way as to extend in the vertical direction; and after a plate has been sucked by the vacuum pads, the vacuum hangers are lifted vertically to separate the sucked uppermost plate from the stacked plates.

Further, Japanese Published Unexamined (Kokai) Utility Model Application No. 3-23132 discloses a vibration type plate material separating apparatus as follows: a stretch member movable up and down by a hydraulic cylinder is provided; a plurality of suction pads are attached to the ends of shafts attached to the stretch member, respectively; and a vibration mechanism is provided for each suction pad to separate the sucked plate from the stacked plates, whenever two or more plates are sucked simultaneously.

In the prior art plate material separating apparatus as described above however although the plate can be lifted and thereby separated from the stacked plates by use of the vacuum pads arranged on the vacuum hanger, when the uppermost plate sticks to the second plate, it is impossible to separate the uppermost plate from the stacked plates. Further, if the vacuum pads attached to the ends of the shafts are vibrated or oscillated, when the sticking force between the two adjacent plates is strong, there exists a case where it is impossible to separate no plate from the stacked plates. Further, when two plates are lifted together, there exists a case where the upper plate cannot be separated from the second plate even if vibrated.

SUMMARY OF THE INVENTION

With these problems in mind, therefore, it is the object of the present invention to provide a plate material separating apparatus which can separate an uppermost plate material one by one from the stacked plate materials securely.

To achieve the above-mentioned object, the present invention provides a plate material separating apparatus, comprising: a horizontal beam (9) movable up and down; a plurality of vacuum hanger members (11) fixedly arranged at regular intervals on both sides of said horizontal beam so as to extend horizontally; a plurality of support vacuum pad devices (13B, 13C; 13D, 13E, 13F; 117A to 117F) attached to each of said vacuum hanger members at regular intervals in a direction perpendicular to an end surface of a plate material (W); a plurality of pivotal take-up vacuum pad means (13A, 113) each attached to an end of each of said vacuum hanger members so as to be located near the end surface of the plate material; and a plurality of driving means (37, 141) each associated with each of said pivotal take-up vacuum pad means, for pivoting said pivotal take-up vacuum pad means to bend the plate material only at and along the end surface thereof so that air can be introduced between an uppermost plate material and a second plate material.

Further, each of said pivotal take-up vacuum pad means (13A) comprises: a pivotal pad body (33); a pivotal body axle (35) attached to said pivotal pad body and slidably engaged with a travel guide (31) formed at the end of each of said vacuum hanger members; a pad axle (45) vertically movably attached to said pivotal pad body; a plurality of take-up vacuum pads (43) arranged at regular angular intervals on a lower end surface of said pad axle; and a spring member (47) interposed between said pivotal pad body and said take-up vacuum pads, for urging said take-up vacuum pads in downward direction.

Further, each of said driving means comprises: an air cylinder (39) attached to the end of each of said vacuum hanger members; and a piston rod (41) actuated by said air cylinder and pivotally connected to the pivotal body axle, when said air cylinder is actuated, said piston rod being moved in a direction that said take-up vacuum pads are pivoted upward to bend only the end surface of the plate material upward.

Further, each of said support vacuum pad devices (13B, 13C) comprises: a push pad body (21) attached to each of said vacuum hanger members; a pad axle (25) vertically movably attached to said push pad body; a vacuum pad (23) attached to a lower end of said pad axle (25); a spring (27) interposed between said push pad body and said vacuum pad to urge said vacuum pad in downward direction; and a hydraulic cylinder (29) disposed on said push pad body to fix said pad axle to said push pad body before the end of the plate material is bent by said pivotal take-up vacuum pad means.

Further, it is also preferable that the support vacuum pad devices (13D to 13F) are arranged on both sides of said horizontal beam, and vertical lengths of said pad axles (49, 51, 53) are increased stepwise in sequence beginning from said pad axle (49) arranged near said pivotal take-up vacuum pad means to bend the end surface of the plate material along further a gentle bent curve over a wide end surface range of the plate material.

Further, it is also preferable that the separating apparatus further comprises a pivotal pad link plate (55) for connecting a plurality of said take-up vacuum pads (43) at the ends of said vacuum hanger members, respectively to take-up the end surface of the plate material uniformly and smoothly.

Further, in another aspect of the present invention, said pivotal take-up vacuum pad means (113) arranged at a corner of the plate material comprises: a stretch member (105); a U-shaped bracket (107) attached to said stretch member; a push pad shaft (123) attached to said U-shaped bracket; a push vacuum pad (109) attached to a lower end of said push pad shaft, for pushing the plate material near a corner of the plate material; a movable block (125); a corner pad shaft (145) attached to said movable block; and a take-up corner vacuum pad (111) attached to said corner pad shaft, for taking up only the corner of the plate material, and said driving means for pivoting said take-up corner vacuum pad comprises: a hydraulic cylinder (141); a piston rod (143) actuated by said hydraulic cylinder; and linked to said movable block, when said piston rod is actuated by said hydraulic cylinder, said movable block being guided obliquely upward along a slot (133) formed in said U-shaped bracket to bend the plate material upward only at the corner thereof so that air can be introduced between an uppermost plate material and a second plate material.

Further, each of said support vacuum pad devices comprises: a pad shaft (115A to 115F) vertically movably attached to said stretch member (105); a vacuum pad (117A to 117F) attached to a lower end of said pad shaft; a shaft stopper (119A to 119F) attached to an upper end of said pad shaft to stop downward motion of said pad shaft; and vertical lengths of said pad shafts (115A to 115F) being increased stepwise in sequence from said pad shaft (115F) arranged near said corner pad shaft (145) to bend the corner end surface of the plate material along further a gentle bent curve over a wide corner surface range of the plate material.

Further, it is also preferable that the separating apparatus further comprises a nozzle (NZ) for introducing air between an uppermost plate material and a second plate material after the plate material has been bent upward by said pivotal take-up vacuum pad means.

In the plate material separating apparatus according to the present invention, since the take-up vacuum pads for sucking at least one end surface or at least one corner portion of the plate W are pivoted to take up the plate material, air can easily enter or be easily jetted from a nozzle to between the uppermost plate and the second plate, so that it is possible to separate the uppermost plate more securely.

BRIEF DESCRIPTION OF THE DRAWINGS

FIGS. 15A and 15B are front and side views for assistance in explaining the operation of the second embodiment of the plate material separating apparatus according to the present invention, in which FIG. 15B is a side view obtained when seen from a direction XVB in FIG. 13A;

DETAILED DESCRIPTION OF THE EMBODIMENTS

The embodiments of the plate material separating apparatus according to the present invention will be described in detail hereinbelow with reference to the attached drawings.

For better understanding, an entire construction of a plate material conveying apparatus for conveying a plate to a plate material processing machine such as turret punch press will be first explained with reference to FIGS. 1A and 1B.

Figure 1A:
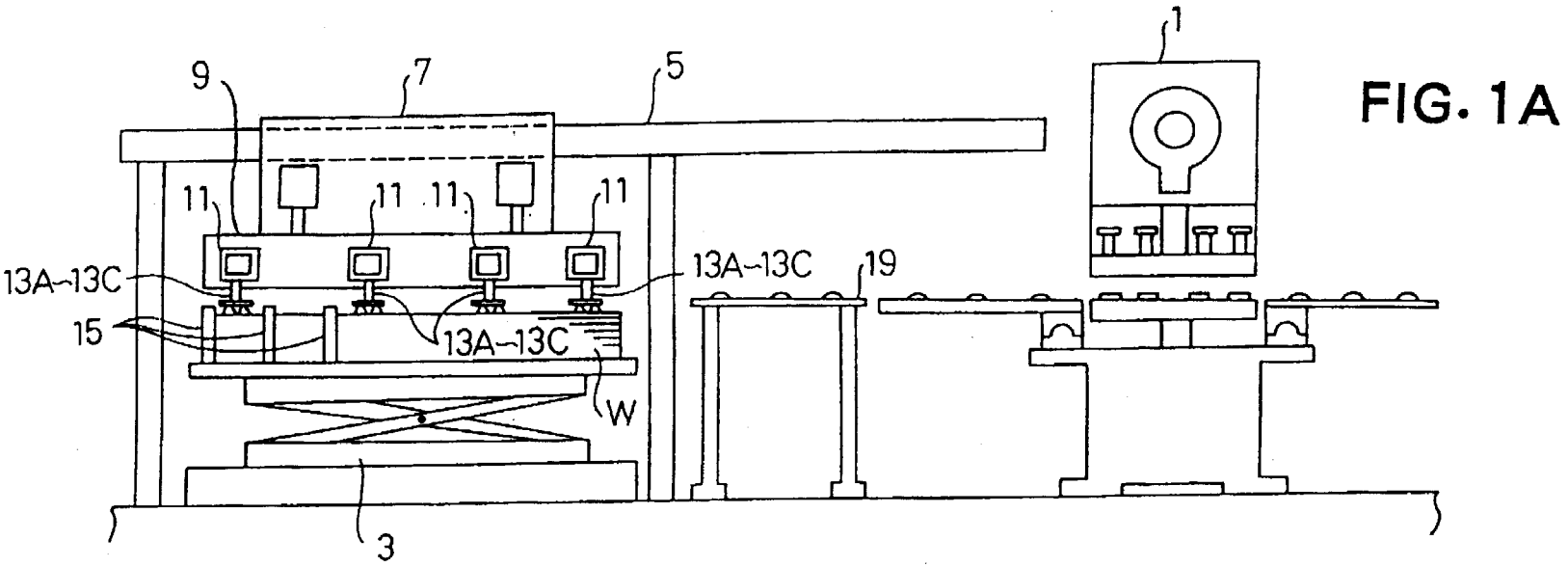
FIG. 1A is an entire side view showing a plate material processing machine, obtained when seen from a direction IA shown in FIG. 1B, to which the plate material separating apparatus according to the present invention is applied.

FIG. 1A is a side view showing a plate material processing machine (i.e., turret punch press) 1, a plate lifting apparatus 3 for moving a plate up and down to mount the plate on the processing machine 1, and a rail conveyor 5 provided horizontally between the turret punch press 1 and the plate lifting apparatus 3. In FIG. 1A, an intermediate table 19 is installed between the plate lifting apparatus 3 and the turret punch press 1.

Figure 1B:
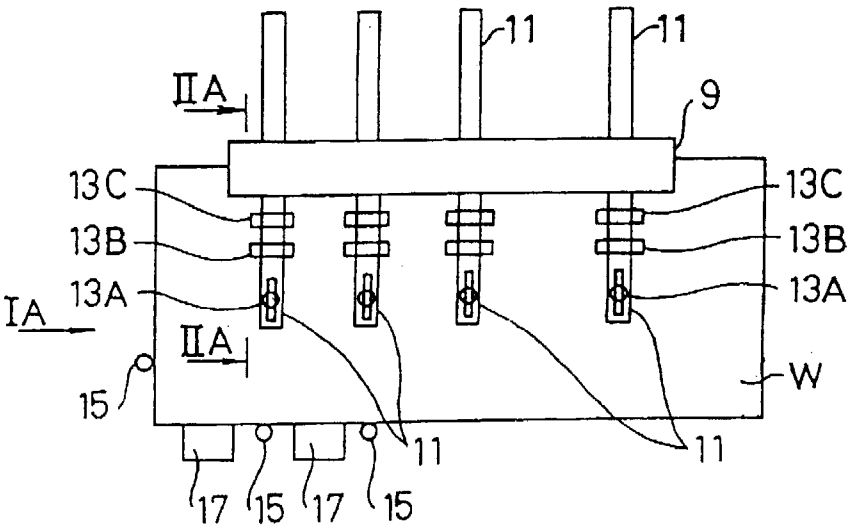
FIG. 1B is a plane view showing a first embodiment of the plate material separating apparatus according to the present invention, obtained when plate material W shown in FIG. 1A is seen from above.
Figure 2A:
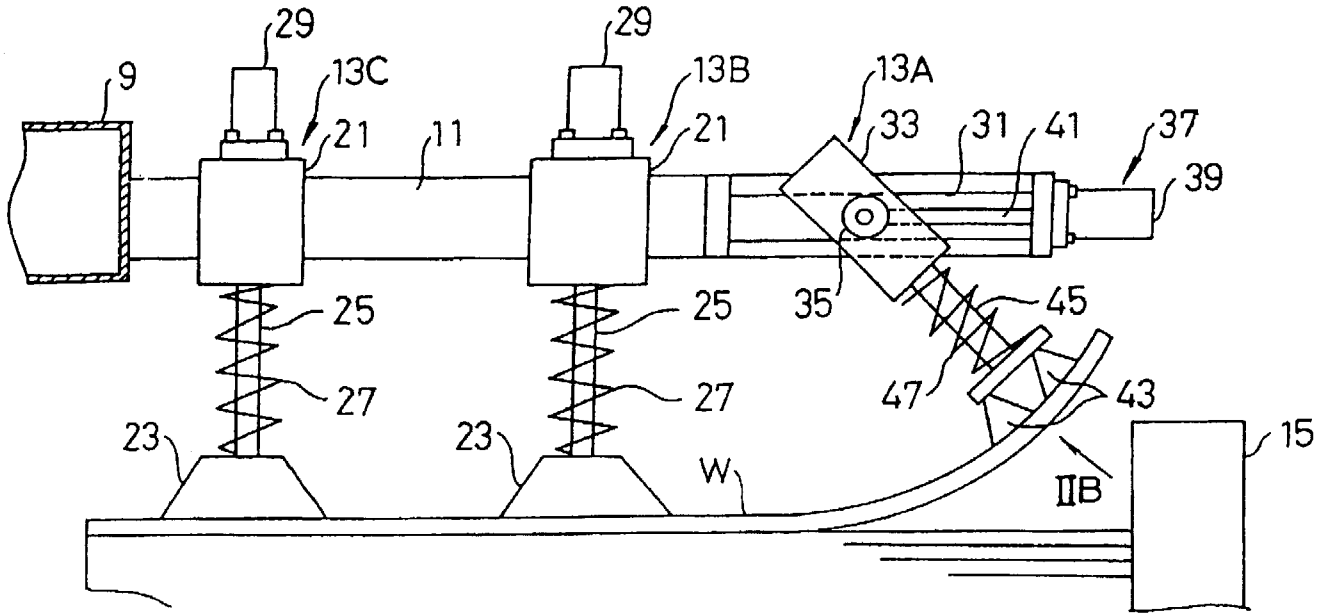
FIG. 2A is an enlarged view showing the first embodiment of the plate material separating apparatus obtained, when seen from a direction IIA in FIG. 1B.

FIG. 1B is a top view showing a first embodiment of the plate material separating apparatus according to the present invention. With reference to FIGS. 1A and 1B, a loader 7 is hung on the rail conveyor 5 so as to be movable to and fro in the horizontal direction. By this loader 7, a horizontal beam 9 is supported so as to be movable up and down in the vertical direction. To this horizontal beam 9, a plurality of vacuum hanger members 11 are attached passing through the horizontal beam 9 and extending in the horizontal direction as depicted in FIG. 1B. To each of these vacuum hanger member 11, a plurality (there in this embodiment) of vacuum pad devices 13A, 13B and 13C are attached, respectively in such a way as to extend in the downward direction, as depicted in FIG. 2A.

Further, a plurality of stopper pins 15 and a plurality of magnet separators (as auxiliary plate separating devices) 17 are arranged on the upper surface of the plate lifting apparatus 3, as shown in FIG. 1B.

In the installation as shown in FIG. 1A, plates W are tacked on the plate lifting apparatus 3 by use of an appropriate lifting apparatus. The loader 7 is moved toward over the plate lifting apparatus 3 to suck, lift and covey the uppermost plate W to the succeeding stage. In more detail, the vacuum hanger members 11 are lowered to suck the plate W by the three vacuum pad devices 13A to 13C. After that, when the vacuum hanger members 11 are lifted, the uppermost plate W can be separated from the stacked plates W under the sucked condition. Then, the loader 7 is moved along the rail conveyor 5 to convey the sucked plate W to the turret punch press 1. When the loader 7 reaches an inlet side table of the turret punch press 1, the three vacuum pad devices 13A to 13C are all released to set the conveyed plate W onto the turret punch press 1, thus ending the conveying motion of the plate W.

The first embodiment of the vacuum pad devices 13A to 13C (which are the essential portion of the present invention) will be described in further detail hereinbelow with reference to FIGS. 2A and 2B.

In FIG. 2A, a plurality of vacuum hanger members 11 are arranged at regular intervals on both sides of the horizontal beam 9 so as to extent in the horizontal direction. Further, to each of these vacuum hanger members 11, a plurality (three) vacuum pad devices 13A, 13B and 13C are arranged. The three vacuum pad devices are composed of a pivotal take-up vacuum pad device 13A and two support vacuum pad devices 13B and 13C. The support vacuum pad devices 13B and 13C are the same in construction. The support vacuum pad device 13B or 13C is composed of a push pad body 21 attached to the vacuum hanger member 11, a pad axle 25 attached to the push pad body 21 so as to be movable up and down, a vacuum pad 23 attached to the lower end of the pad axle 25, and a spring 27 interposed between the push pad body 21 and the vacuum pad 23 to urge the vacuum pad 23 in the downward direction. Further, on the upper portion of the pad axle 25, a hydraulic or air cylinder 29 is disposed to fix the pad axle 25 to the push pad body 21.

On the other hand, the structure of the pivotal take-up vacuum pad device 13A is different from that of the support vacuum pad devices 13B and 13C. In more detail, the vacuum hanger member 11 is formed with a travel guide 31 at a free end thereof so as to extend in the horizontal direction of the vacuum hanger member 11. The pivotal take-up vacuum pad device 13A is composed of a pivotal pad body 33, a pivotal body axle 35 fixed to the pivotal pad body 33 and slidably engaged with the travel guide 31 of the vacuum hanger member 11, a pad axle 45 attached to the pivotal pad body 33 so as to be movable up and down, a plurality of small-diameter take-up vacuum pads 43 attached to the lower end of the pad axle 45, and a spring 47 interposed between the pivotal pad body 33 and the small-diameter take-up vacuum pads 43 to urge the take-up vacuum pads 43 in the downward direction. Further, on the free end of the vacuum hanger member 11, an air cylinder (driving means) 37 is provided. A piston rod 41 of this air cylinder 39 is pivotally connected to the pivotal body axle 35.

Figure 2B:
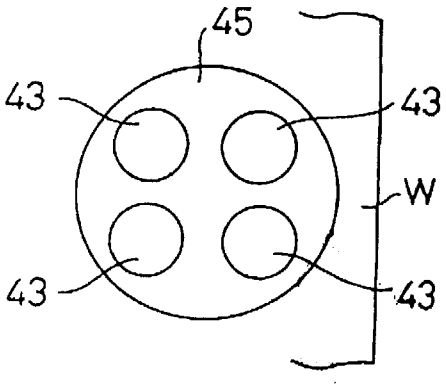
FIG. 2B is four small-diameter take-up vacuum pads, when seen from a direction IIB in FIG. 2A.

Further, as depicted in FIG. 2B, a plurality (four in this embodiment) of the small-diameter take-up vacuum pads 43 are arranged at regular angular intervals on the lower end of the pad axle 45. In this arrangement, it is essential to arrange the small-diameter take-up vacuum pads 43 in parallel to and in close vicinity of an end surface (edge) portion of the plate material W. Further, as shown in FIG. 1B, the plate material W is located along a base line by the stopper pins 15, and one end surface of the uppermost plate W mounted on the plate lifting apparatus 3 is particularly taken up by the pivotal take-up vacuum pad device 13A under sucked conditions.

The operation of the plate material separating apparatus according to the present invention will be described hereinbelow with reference to FIGS. 3A to 3D.

Figure 3A:
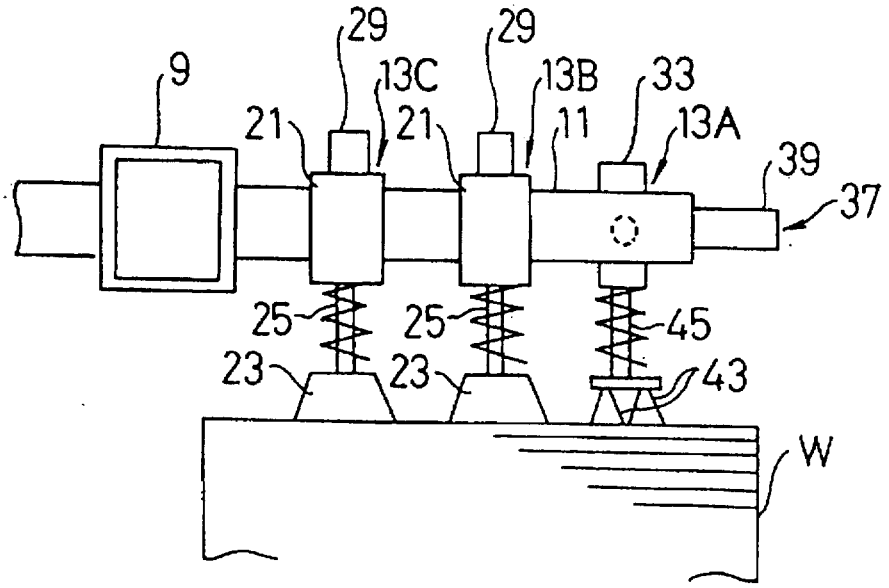
FIGS. 3A to 3D are illustrations for assistance in explaining the operation of the first embodiment of the plate material separating apparatus according to the present invention.

First as shown in FIG. 3A, the horizontal beam 9 is lowered to suck the plate material W by the vacuum pads 23 and 43 of the vacuum pad devices 13A, 13B and 13C attached to the vacuum hanger members 11. In this case, a vacuum pump (not shown) is actuated to reduce the pressure within the respective vacuum pads 23 and 43 into a vacuum. Further, the hydraulic cylinders 29 disposed on the push pad bodies 21 are actuated to stop the vertical motion of the support vacuum pad devices 13B and 13C, that is, to stop the vertical motion of the pad axles 25. Therefore, the vertical strokes of the vacuum pads 23 of the support vacuum pad devices 13B and 13*b* are fixed.

Figure 3B:
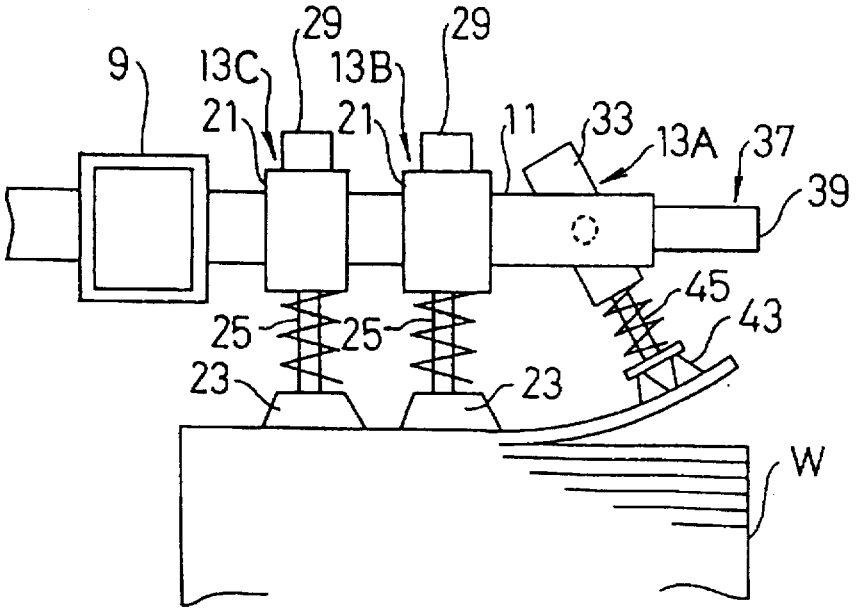
Figure 3C:
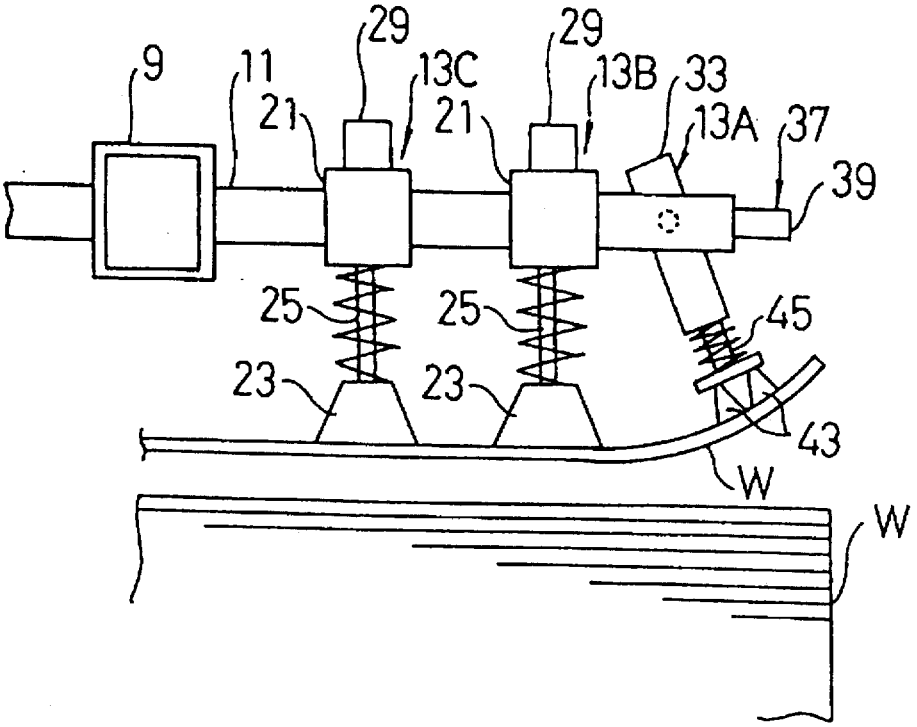

Under these conditions, as shown in FIG. 3B, the vacuum hanger members 11 are slightly lifted, and at the same time each pivotal take-up vacuum pad device 13A is driven by actuating the air cylinder 39 (i.e., the driving member 37) toward the left side along the travel guide 31 formed at the free end of the vacuum hanger member 11 respectively, so that the pivotal pad body 33 can be pivoted counterclockwise to bend the uppermost plate material only at and along the end surface thereof as shown.

Owing to the above-mentioned operation, only the end surface of the uppermost plate W can be taken up as if the book page is turned over. In this case, since air enters gradually from the end surface of the plate W to a space between the uppermost plate W and the second plate W, it is possible to reduce the contact force between the two adjoining plates W, so that the uppermost plate W can be partially separated easily from the second plate W at the end of the plate W.

Further, it is not always necessary to fix the vertical motions of both the support vacuum pad devices 13B and 13C by the hydraulic cylinders 29. That is, when the plate thickness is large, only the support vacuum pad device 13C is fixed by the hydraulic cylinder 29 to allow the plate W to be easily bent upward by the pivotal take-up vacuum pad device 13A. On the other hand, when the plate thickness is small (e.g., less than 1.6 mm), only the support vacuum pad device 13B is fixed by the hydraulic cylinder 29 because the plate W can be easily bent upward.

Figure 3D:
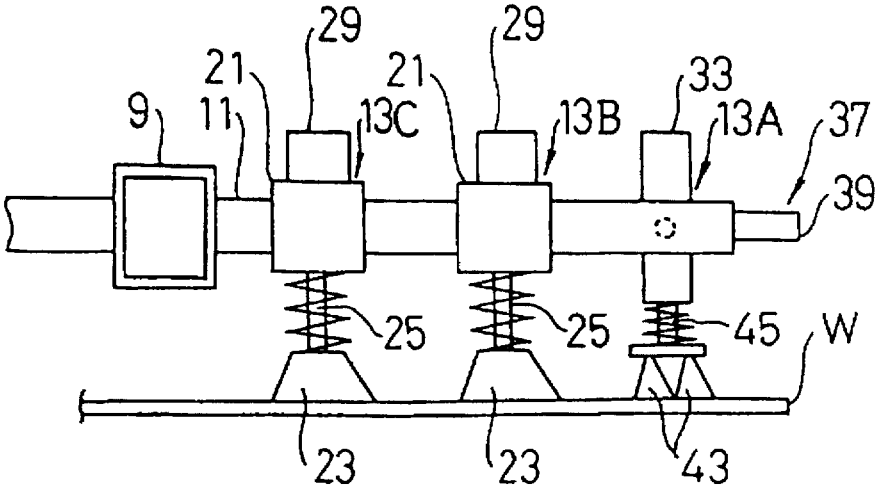

Under the conditions as described above, as shown in FIG. 3C, the horizontal beam 9 is further lifted to completely separate the uppermost plate W from the stacked plates W. Further, as shown in FIG. 3D, each air cylinder 39 of the pivotal take-up vacuum pad device 13A is actuated again to return the take-up pads 45 to the original vertical position respectively, that is, to support the plate W in the horizontal direction by the three vacuum pad devices 13A to 13C. After that, the hydraulic cylinders 29 of the support vacuum pad devices 13B and 13C are opened to release their pad axles 25, respectively. After that, the plate W is conveyed by the loader 7 to the succeeding process.

In the plate material separating apparatus according to the present invention, since only the end surface of the uppermost plate W can be taken up by the pivotal take-up vacuum pad devices 13A, the contact force between the uppermost and second plates can be reduced effectively, so that it is possible to securely separate the uppermost plate W from the second plate W.

A first modification of the first embodiment of the plate material separating apparatus according to the present invention will be described hereinbelow with reference to FIGS. 4A and 4B. In this modification, four vacuum pad devices 13A, 13D, 13E, and 13F are attached to each vacuum hanger member 11 on both sides thereof and further the support vacuum pad devices 13D to 13F are arranged in such a way that the vertical positions of the respective vacuum pads 23 of the support vacuum pad devices 13D to 13F are lowered stepwise.

Therefore, the same reference numerals have been retained for the similar parts or elements which have the same functions as with the case of the first embodiment shown in FIGS. 2A and 2B, without repeating the same detailed description thereof.

The points of this modification different from the first embodiment are as follows: A pivotal take-up vacuum pad device 13A and a support vacuum pad device 13D are attached on one side of the vacuum hanger member 11, and support vacuum pad devices 13E and 13F are attached to the other side of the vacuum hanger member 11. Further, the vertical lengths of the pad axles 49, 51 and 53 are increased stepwise in sequence beginning from the pad axle 49 arranged near the pivotal take-up vacuum pad device 13A to bent the end surface of the plate material along further a gentle bent curve over a wide end surface range of the plate material.

The construction of the pivotal take-up vacuum pad device 13A is quite the same in construction as that of the first embodiment. Further, the construction of the support vacuum pad devices 13D to 13F are the same in construction as that of the first embodiment, except that the vertical lengths of the pad axles 49, 51 and 53 are different from each other. In more detail, as shown in FIG. 4B, the lengths of the pad axles 49, 51 and 53 are determined in different way in such a way the vacuum pads 23 of the support vacuum pad devices 13D to 13F can be lowered stepwise dimension L by dimension L from the base line of the lower surface position of the small-diameter vacuum pads 43 of the pivotal take-up vacuum pad device 13A.

Figure 5A:
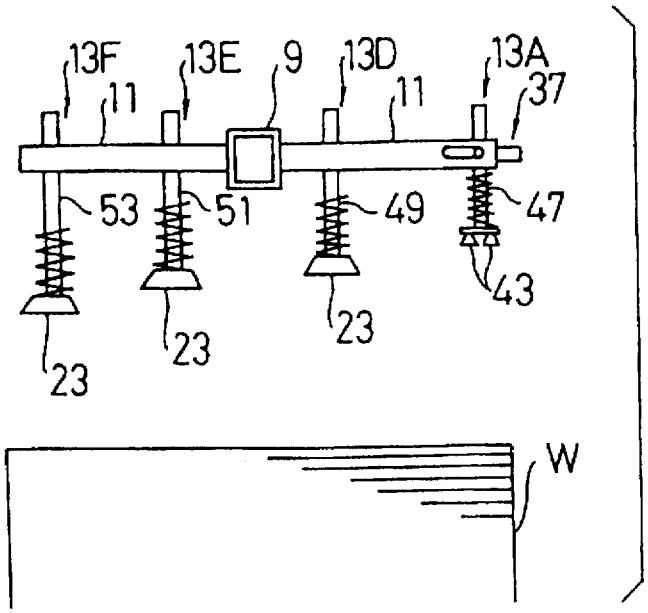
FIGS. 5A to 5E are illustrations for assistance in explaining the operation of the first modification of the first embodiment of the plate material separating apparatus.
Figure 5B:
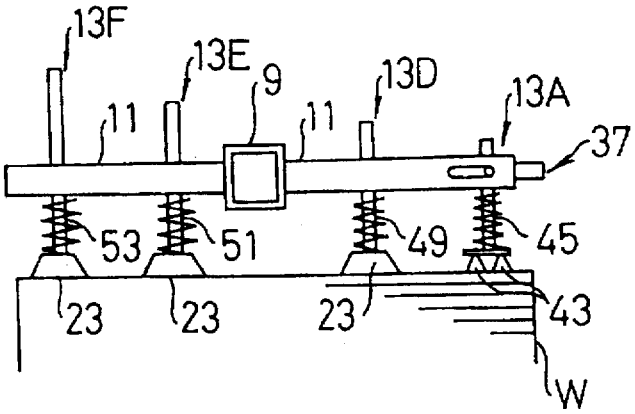
Figure 5C:
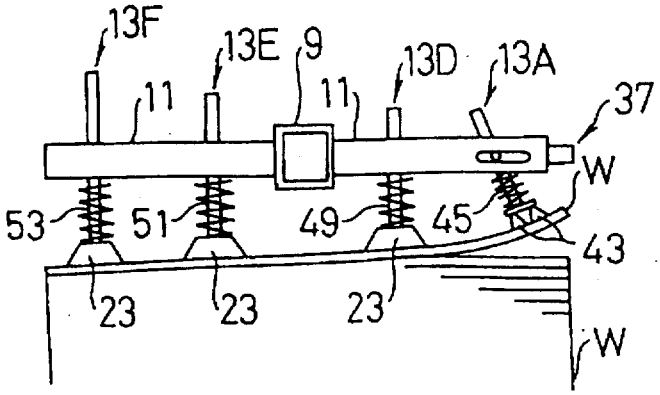
Figure 5D:
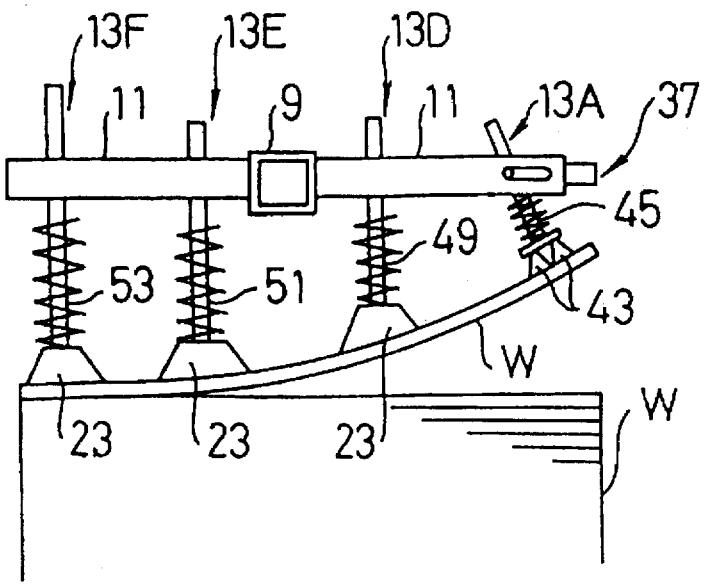
Figure 5E:
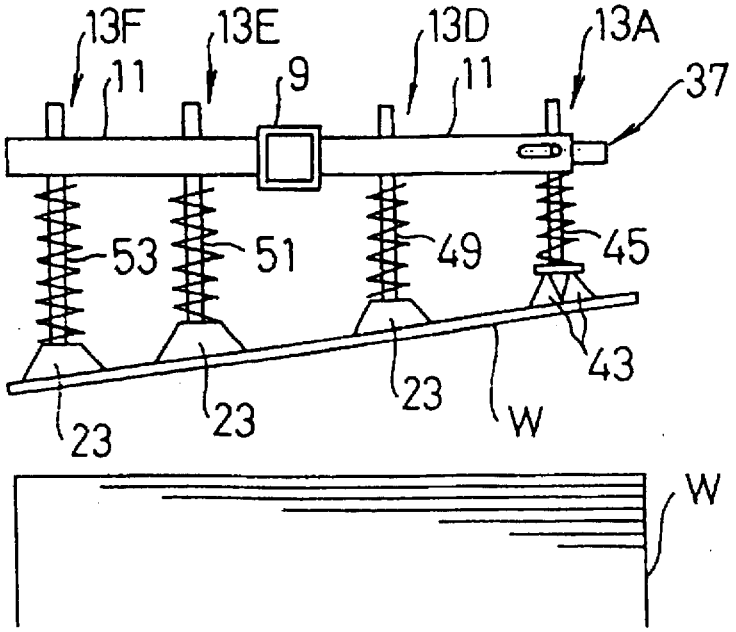

With reference to FIGS. 5A and 5E, the operation of this modification will be described hereinbelow. First, the horizontal beam 9 is lowered from the standby position as shown in FIG. 5A to the suction position as shown in FIG. 5B to push the vacuum pads 23 and 43 against the uppermost plate W of the stacked plate w. Under these conditions, the vacuum pump (not shown) is actuated to suck the plate W. After the uppermost plate W is sucked by these vacuum pads 23 and 43, only each of the pivotal take-up vacuum pad devices 13A is actuated by the air cylinder 39 (the driving member 37) to take up one end of the uppermost plate W, as shown in FIG. 5C. Under these conditions, when the horizontal beam 9 is lifted gradually, the uppermost plate W can be lifted beginning from the end of the plate W gradually in the order of the support vacuum pad devices 13D to 13F, as shown in FIG. 5D. After the plate W has been completely separated from the stacked plates W as shown in FIG. 5E, the small-diameter vacuum pads 43 of the take-up vacuum pad device 13A are returned to the original vertical position, so that the plate W can be separated from the stacked plates completely.

Figure 4A:
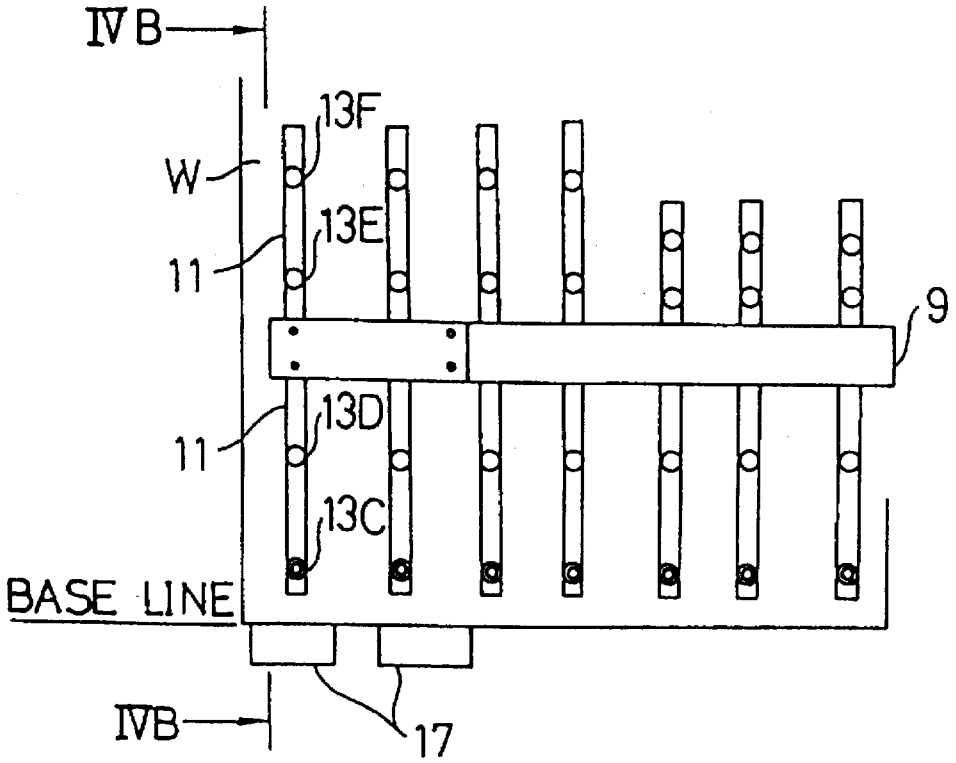
FIG. 4A is a plane view showing a first modification of the first embodiment of the plate material separating apparatus according to the present invention.
Figure 4B:
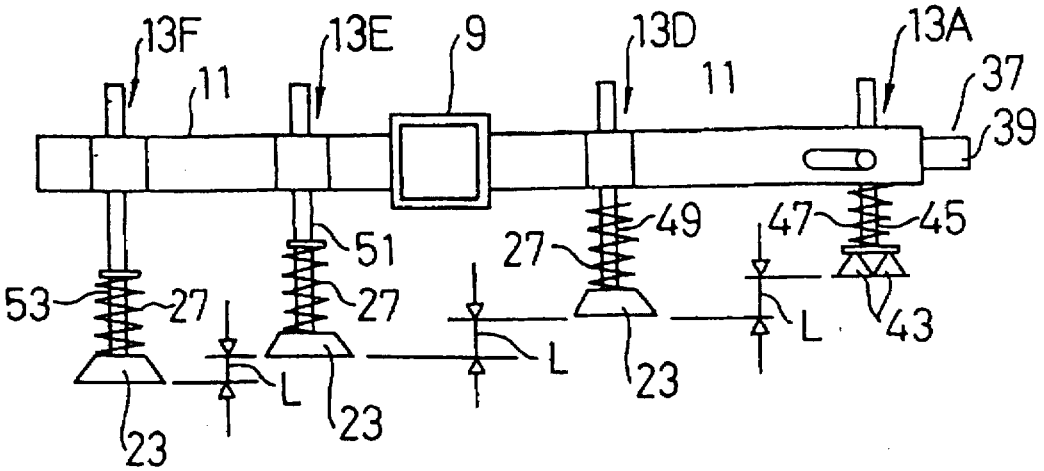
FIG. 4B is an enlarged side view showing the first modification of the first embodiment of the plate material separating apparatus shown in FIG. 4A, obtained when seen from a direction IVB shown in FIG. 4A.

Further, although not shown in FIGS. 4A and 4B, since an air cylinder is provided for each pad axle 49, 51 or 53, when these air cylinders are actuated, it is possible to change the vertical positions of the pad axles 49, 51 and 53, respectively and appropriately, so that the sucked plate W can be supported horizontally, where preferable for conveyance of the plate material to the succeeding stage.

As described above, in this modification, after the end surface of the uppermost plate W has been taken up by the take-up vacuum pad devices 13A, since the uppermost plate W can be separated from the second plate W by gradually introducing air between the uppermost plate W and the second plate W with the use of the different-length support vacuum pad devices 13D to 13F, it is possible to separate the uppermost plate W all over the surface of the plate W more securely and more rapidly.

Figure 6A:
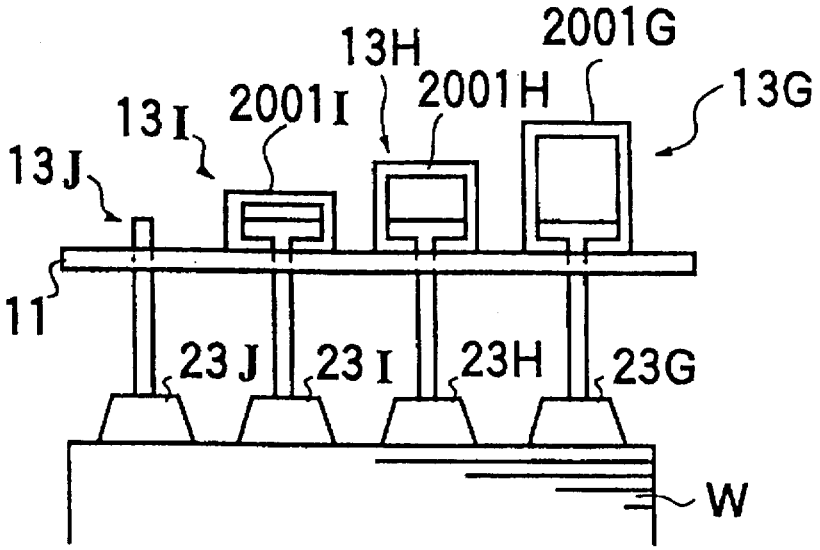
FIG. 6A is a side view showing a second modification of the plate material separating apparatus.
Figure 6B:
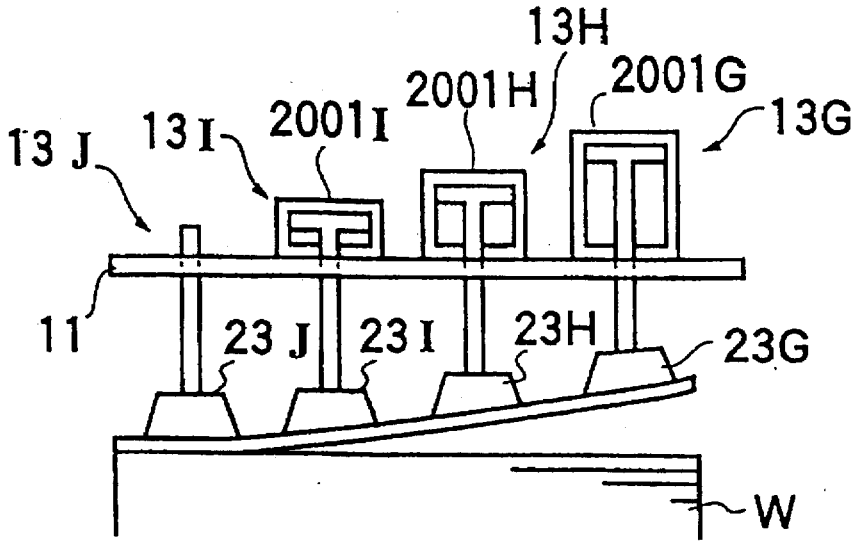
FIG. 6B is a side view for assistance in explaining the operation of the second modification shown in FIG. 6A.

A second modification of the plate material separating apparatus will be described hereinbelow with reference to FIG. 6A. In this modification, four vacuum pad devices 13G, 13H, and 13I have air cylinders 2001G, 2001H, and 2001I respectively. The lengths of the air cylinders 2001G, 2001H, and 2001I are dimensioned in such a way that the lengths of strokes of the air cylinder 2001G to 2001I are decreased stepwise in sequence beginning from the air cylinder 2001G which is located at the end of vacuum hanger member 11 near to the portion of the workpiece W to be taken up. In this construction, when the air cylinders 2001G, 2001H, and 2001I are actuated, the vacuum pads 23G, 23H, and 23I are lifted by the lengths of the strokes of the cylinders 2001G, 2001H, and 2001I respectively. As a result the position of the vacuum pad 23G becomes highest and the end portion of the workpiece W is taken up as shown in FIG. 6B.

Figure 7A:
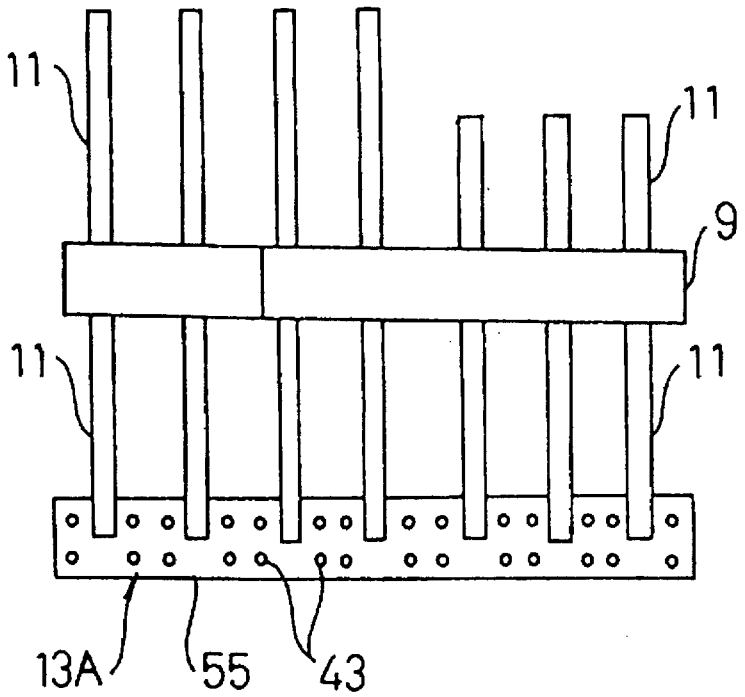
FIG. 7A is a plane view showing a second modification of the first embodiment of the plate material separating apparatus according to the present invention.
Figure 7B:
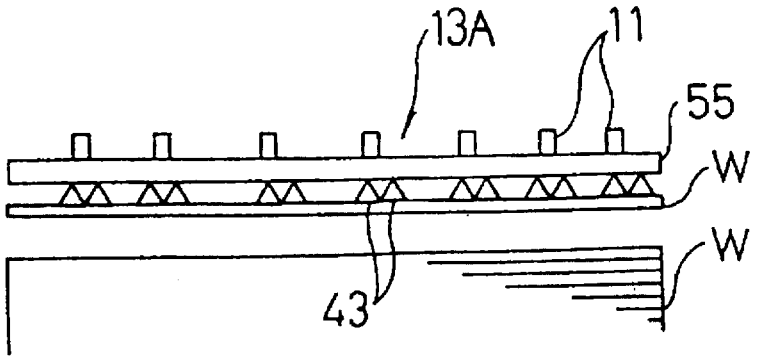
FIG. 7B is an enlarged front side view showing the second modification of the first embodiment of the plate material separating apparatus shown in FIG. 7A.

A second modification of the plate material separating apparatus according to the present invention will be described hereinbelow with reference to FIGS. 7A and 7B. In this modification, the small-diameter take-up vacuum pads 43 of all the take-up vacuum pad devices 13A attached to all the vacuum hanger members 11 are all linked together by a pivotal pad link plate 55. Therefore, the same reference numerals have been retained for the similar parts or elements which have the same functions as with the case of the first embodiment shown in FIGS. 2A and 2B, without repeating the same detailed description thereof.

In this second modification, since the take-up vacuum pads 43 are all linked with each other, it is possible to take-up the end surface of the plate W more uniformly and more smoothly over the total length of one side of the plate W. Therefore, it is possible to obtain a more reliable separation operation of the uppermost plate W from the stacked plates W.

Figure 8:
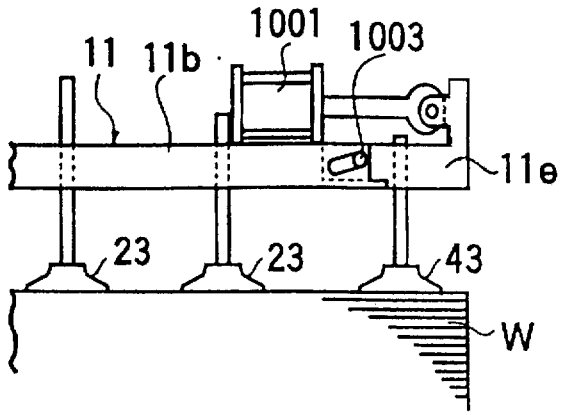
FIG. 8 is a side view showing a third modification of the first embodiment of the plate material separating apparatus according to the present invention.

A third modification of the plate material separating apparatus will be described hereinbelow with reference to FIG. 8. In this modification, each vacuum hanger member 11 is divided into a base portion 11*b* and a work-end portion 11*e*. This work-end portion 11*e* is pivotal upward by an air cylinder 1001 mounted on the base portion 11*b* with a fulcrum 1003 as its center. A plurality of the support vacuum pads 23 are attached to the base portion 11*b*, and the take-up vacuum pad 43 is attached to the work-end portion 11*e* of the vacuum hanger member 11.

Therefore, when the air cylinder 1001 is actuated, since the work-end portion 11*e* of the vacuum hanger member 11 is pivoted upward about the fulcrum, the take-up vacuum pad 43 is moved and further pivoted upward to bring up an end of the uppermost work W.

Figure 9:
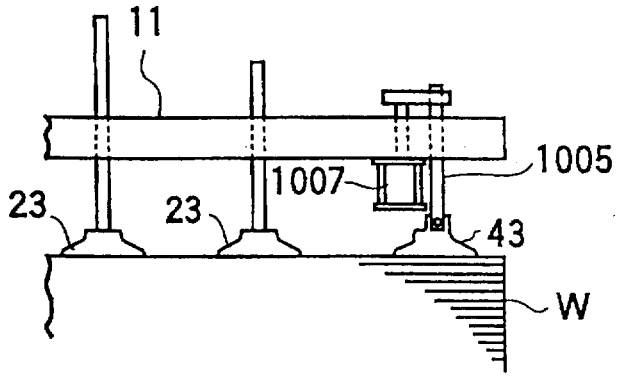
FIG. 9 is a side view showing a fourth modification thereof.

A fourth modification of the plate material separating apparatus will be described hereinbelow with reference to FIG. 9. In this modification, an air cylinder 1007 is attached to an end portion of the vacuum hanger member 11. The upper end of a pivotal mount shaft 1005 is pivotally linked to the air cylinder 1007 via a link rod. Further, the lower end of the pivotal mount shaft 1005 is attached to the take-up vacuum pad 43 being offset away from the center of the vacuum pad 43 toward the work-end side.

Therefore when the air cylinder 1007 is actuated since the mount shaft 1005 is moved upward via the link rod the take-up vacuum pad 43 is moved and further pivoted upward to bring up an end of the uppermost work W.

Figure 10:
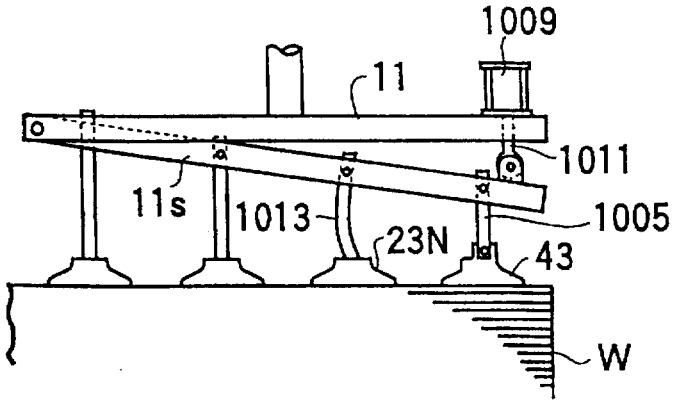
FIG. 10 is a side view showing a fifth modification thereof.

A fifth modification of the plate material separating apparatus will be described hereinbelow with reference to FIG. 10. In this modification, a pivotal vacuum hanger member 11*s* is additionally attached to each vacuum hanger member 11. An air cylinder 1009 is mounted on an end of the vacuum hanger member 11, and a piston rod 1011 of this air cylinder 1009 is linked to the end of the pivotal vacuum hanger member 11*s*. The upper end of a pivotal mount shaft 1005 is pivotally linked to the pivotal vacuum hanger member 11*s*. Further, the lower end of the pivotal mount shaft 1005 is attached to the take-up vacuum pad 43 being offset away from the center of the vacuum pad 43 toward the work-end side, in the same way as in the fourth modification. Further, a mount shaft 1013 of the support vacuum pad 23N adjacent to the take-up vacuum pad 43 is so formed as to be slightly deformable when the work W is being sucked.

Therefore, when the air cylinder 1009 is actuated, since the pivotal vacuum hanger member 11*s* is pivoted upward, the take-up vacuum pad 43 is also moved upward and further pivoted, to bring up the end of the uppermost work W. Further until the deformable mount shaft 1013 of the support vacuum pad 23N is restored straight, since the work W is kept pushed downward by this vacuum pad 23N, the work end can be brought up more easily.

Figure 11:
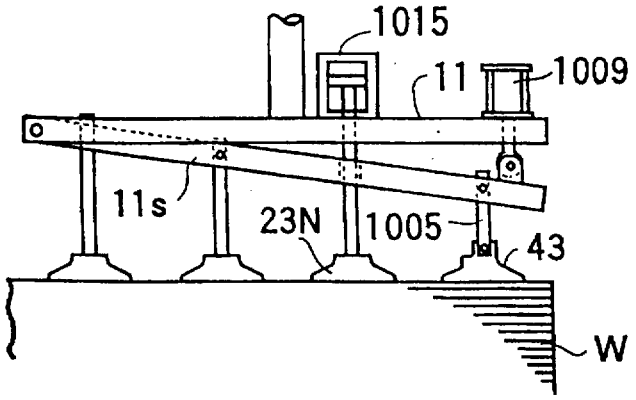
FIG. 11 is a side view showing a sixth modification thereof.

A sixth modification of the plate material separating apparatus will be described hereinbelow with reference to FIG. 11. This modification is basically the same as the fifth modification, except that another air cylinder 1015 is further mounted on the vacuum hanger member 11 to push the adjacent vacuum pad 23N downward when the work W is being brought up by the take-up vacuum pad 43. In this modification, the mount shaft of the adjacent vacuum pad 23N is passed through a hole formed in the pivotal vacuum hanger member 11*s*.

A seventh modification of the plate material separating apparatus will be described hereinbelow with reference to FIGS. 12A, and 12B. This modification is basically the same as the fourth modification shown in FIG. 9 except an air cylinder 2005, an shaft 2006, and vacuum pad 2007. The air cylinder 2005 is mounted on the vacuum hanger member 11 obliquely. The piston rod of the air cylinder 2005 is provided with the shaft 2008 via a link rod. The shaft 2008 is in parallel with the air cylinder 2005 and movable along the axis of shaft 2006. The lower end of the shaft 2006 is provided with the vacuum pad 2007.

Figure 12A:
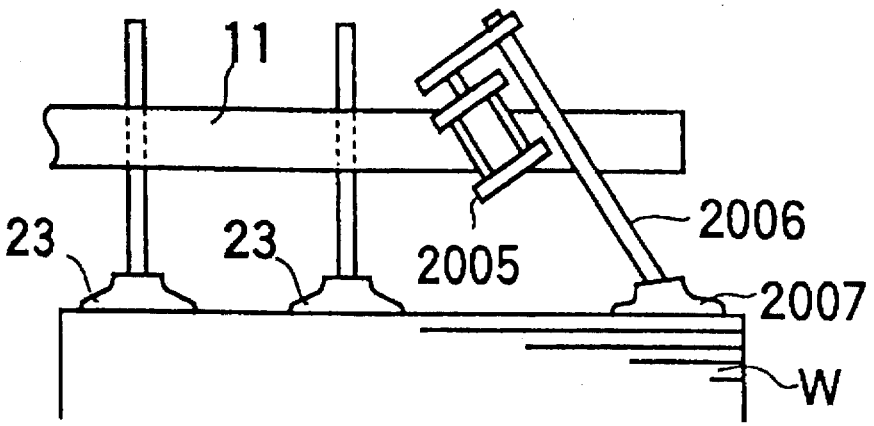
FIG. 12A is a side view showing a seventh modification of the plate material separating apparatus.
Figure 12B:
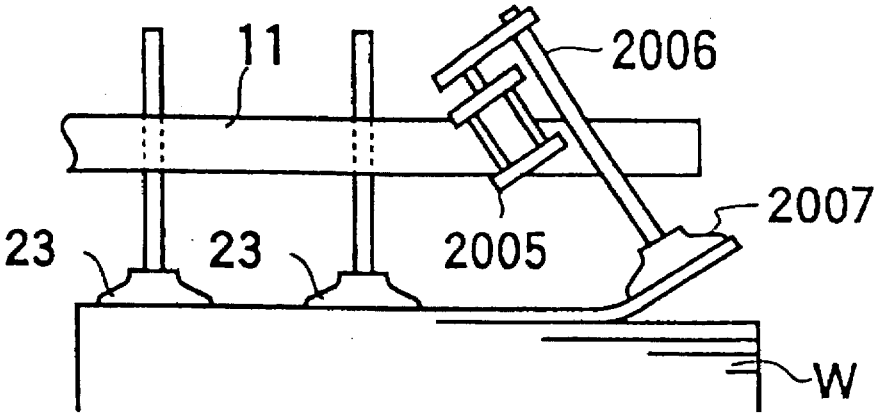
FIG. 12B is a side view for assistance in explaining the operation of the seventh modification shown in FIG. 12A.

With reference to FIGS. 12A, and 12B, the operation of this modification will be described hereinbelow. At first as shown in FIG. 12A, the vacuum pad 2007 is pushed against the surface of the work W obliquely and the shape of the vacuum pad 2007 is deformed. Next the air inside the vacuum pad 2007 is sucked, then the vacuum pad 2007 is sticked to the work W. When the air cylinder 2005 is actuated and the shaft 2006 is mooved upwardly obliquely, the vacuum pad 2007 is restored in the original shape by the elasticity of the vacuum pad 2007. As a result the end portion of the work W is taken up so that the surface of the end portion become perpendicular to the shaft 2006.

Figure 13A:
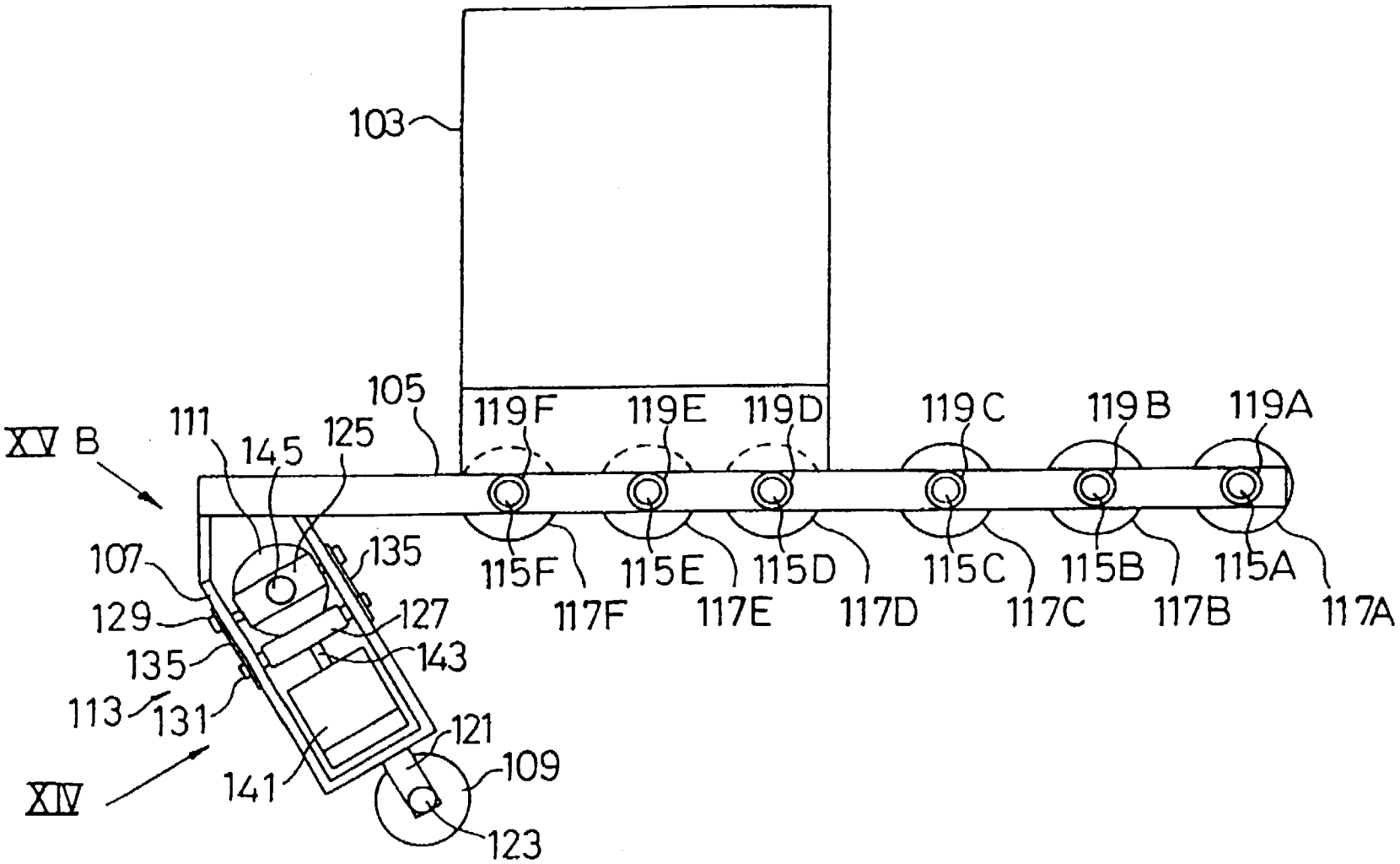
FIG. 13A is a plane view showing a second embodiment of the plate material separating apparatus according to the present invention.
Figure 13B:
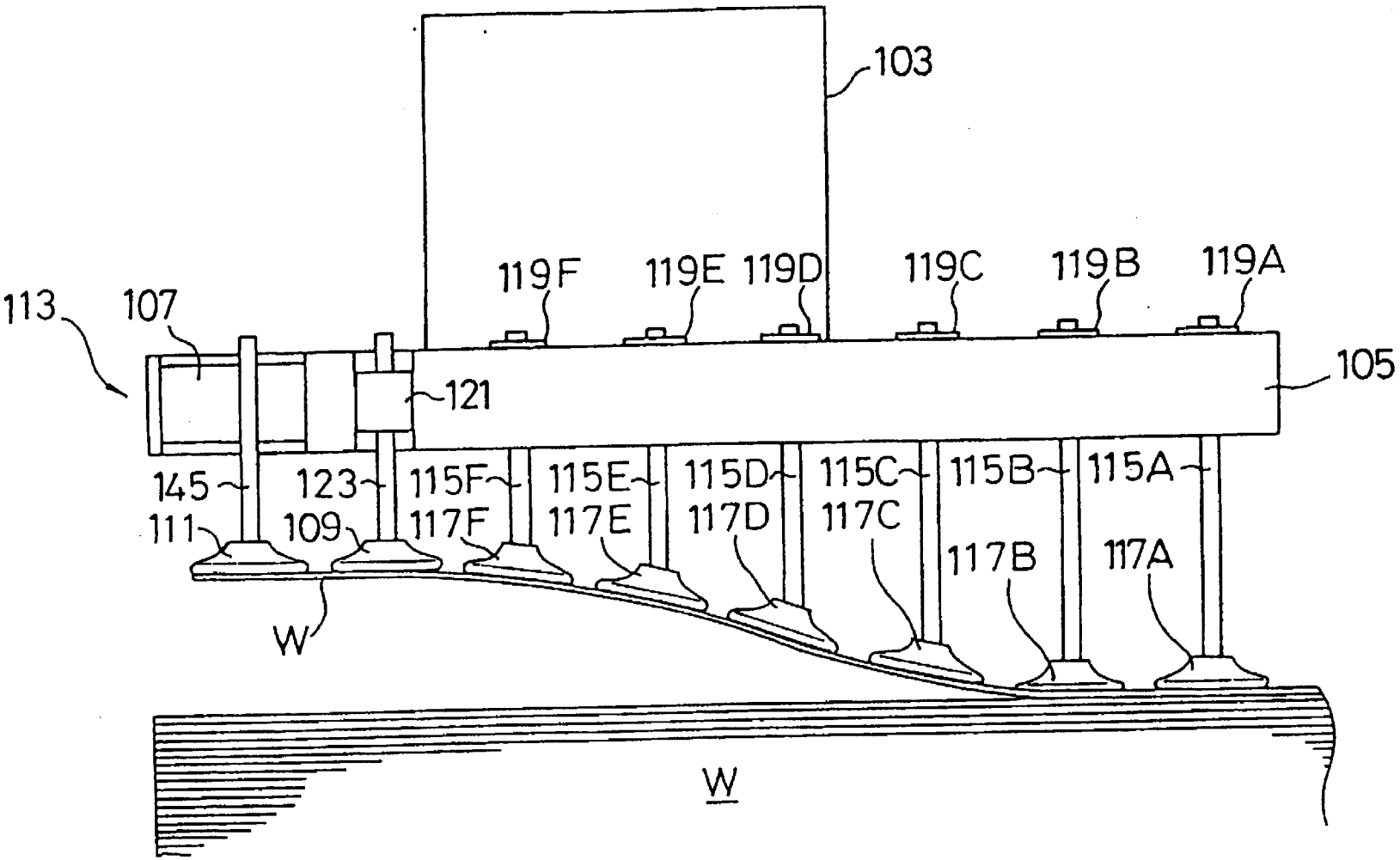
FIG. 13B is a front view showing the same second embodiment of the plate material separating apparatus shown in FIG. 13A.

A second embodiment of the plate material separating apparatus according to the present invention will be described hereinbelow with reference to FIGS. 13A and 13B, which is particularly effective when a plate is taken up at a corner of the plate material W. In FIGS. 13A and 13B, the separating apparatus is provided with a loading unit 103 movable in the vertical direction and further shiftable in the horizontal direction by a hydraulic cylinder (not shown), for instance. This loading unit 103 is provided with a stretch member 105 attached to the lower portion of the loading unit 103 so as to extend in the horizontal direction to a corner of the plate material W.

At one end of this stretch member 105, a pivotal take-up vacuum pad device 113 suitable for taking up a corner of a plate material W is attached. In more detail, a U-shaped bracket 107 is formed integral with the stretch member 105 on an end side (the left side end in this embodiment) of the plate material in FIG. 11B. This bracket 107 is provided with a pivotal take-up vacuum pad unit 113 including a push vacuum pad 109 and a take-up corner vacuum pad 111.

In addition, a plurality of support vacuum pad devices are arranged along the stretch member 105. In more detail, a plurality of pad shafts 115A to 115F are slidably fitted to the stretch member 105 being arranged at appropriate intervals along the horizontal direction in FIGS. 13A and 13B. A plurality of vacuum pads 117A to 117F are attached to the lower ends of the pad shafts 115A to 115F, respectively in such a way that the vacuum pads 117A to 117F can be deformed obliquely when the plate W is hung. Further, a plurality of shaft stoppers 119A to 119F are provided at the upper portions of the pad shafts 115A to 115F, respectively to stop the downward motion of the pad shafts 115A to 115F. As shown in FIG. 13B, the lengths of the pad shafts 117A to 117F are determined to be increased stepwise in sequence beginning from the pad shaft 115F arranged near the corner pad shaft 145 to bend the corner end surface of the plate material along further a gentle bent curve over a wide corner surface range of the plate material W.

Figure 14:
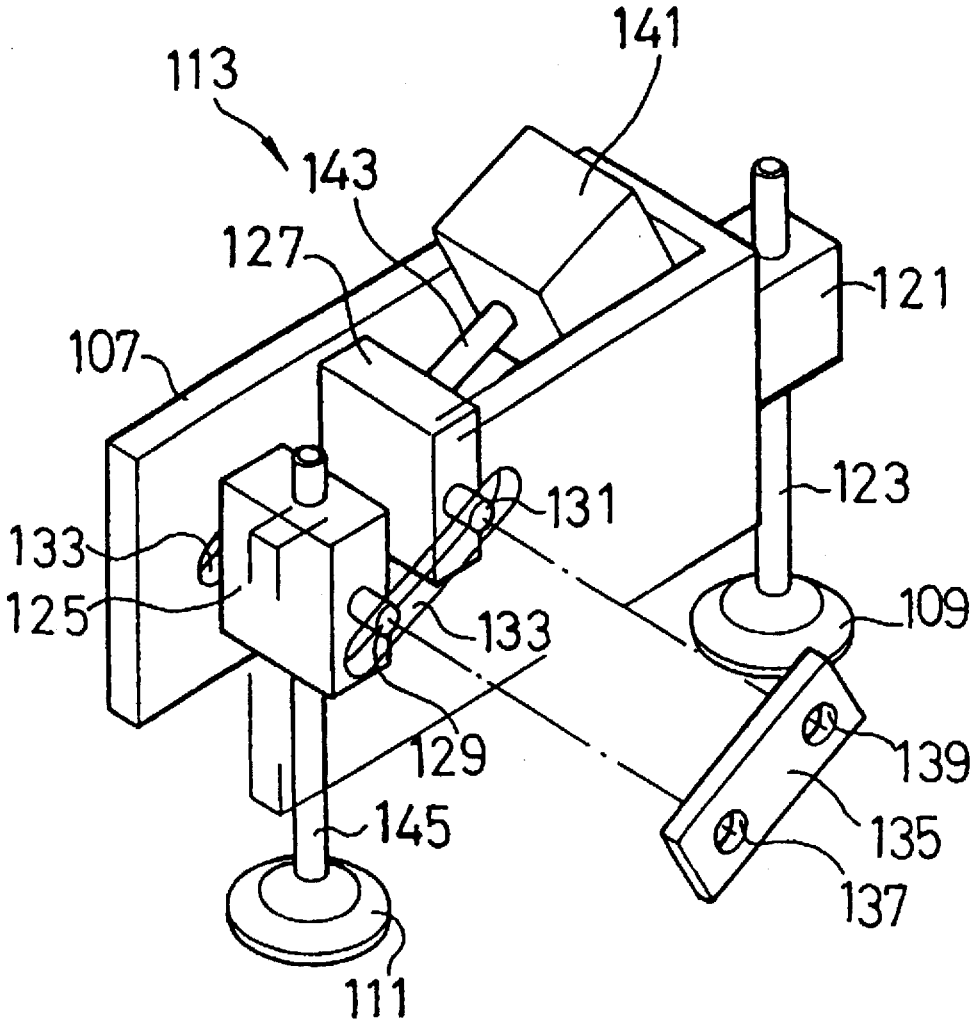
FIG. 14 is a perspective view showing the essential portion of the second embodiment, when seen from a direction XIV shown in FIG. 13A.

With reference to FIGS. 13A, 13B and 14, the pivotal take-up vacuum pad unit 113 will be described in further detail. A fixed block 121 is attached to the bracket 107. To this fixed block 121, the push pad shaft 123 having a length roughly the same as that of the pad shaft 115F is attached. Further, the push vacuum pad 109 is attached to the lower end of this pad shaft 123

Within the bracket 107, two movable blocks 125 and 127 are provided. These movable blocks 125 and 127 are formed with projecting rods 129 and 131, respectively as shown in FIG. 14. These projecting rods 129 and 131 project outward from two oblique slots 133 formed in both side surfaces of the bracket 107, respectively. Further, the ends of these projecting rods 129 are fitted to two holes 135 and 137 formed in both side plates 135, respectively. Further, a hydraulic cylinder 141 is provided on the right side of the bracket 107 in FIG. 14. A piston rod 143 of this hydraulic cylinder 141 is connected to the movable block 127.

To the movable block 125, a corner pad shaft 145 whose length is roughly the same as that of the pad shaft 123 is attached extending in the vertical direction. To the lower end of this corner pad shaft 145, the pivotal take-up corner vacuum pad 111 is attached. The above-mentioned take-up vacuum pad 111, the push vacuum pad 109, and the support vacuum pads 117A to 117F can suck or release the plate W as already explained.

In the construction as described above, when the hydraulic cylinder 141 is actuated, since the piston rod 143 is retracted into the cylinder 141, the movable block 127 is moved toward the right side in FIG. 14, so that the rod 131 is shifted along the oblique slots 133 toward the upper right side. In this case, since the rod 131 is fitted to the holes 139 of the side plates 135 the side plates 135 are also moved in the upper right side. In the same way, since the rod 129 is fitted to the holes 137 of the same plates 135, the movable block 125 is also moved toward the upper right side. As a result, the take-up corner vacuum pad 111 attached to the lower end of the corner pad shaft 145 fitted to the movable block 125 is shifted obliquely toward the upper right side in FIG. 14, with the result that the take-up corner vacuum pad 111 is pivoted clockwise in FIG. 13B.

The operation of the second embodiment of the plate material separating apparatus according to the present invention will be described hereinbelow with reference to FIGS. 15A to 17B. Here, it should be noted that FIGS. 15B, 16B and 17B are all side views obtained when seen from a direction XVB shown in FIG. 13A.

Figure 15A:
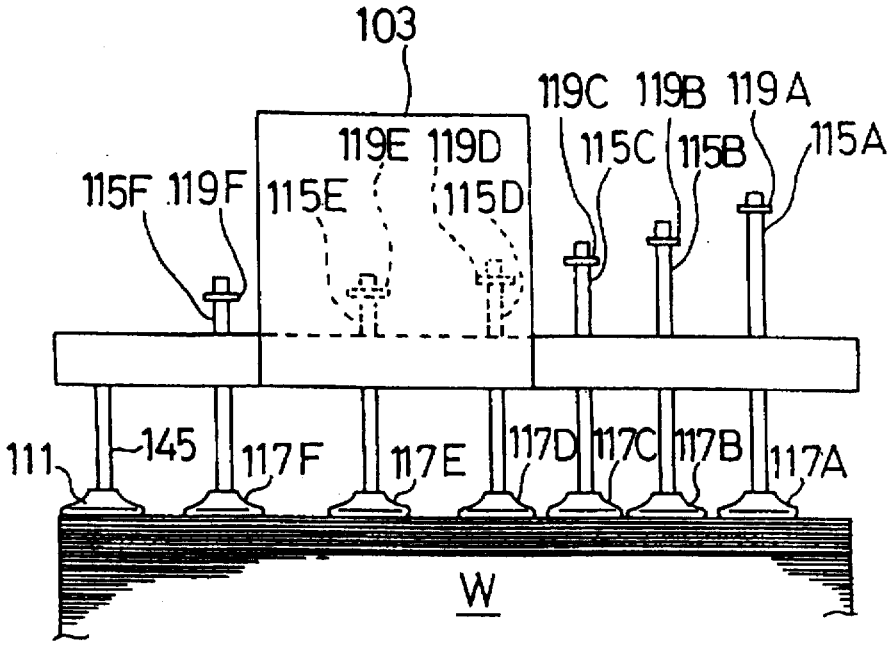
Figure 15B:
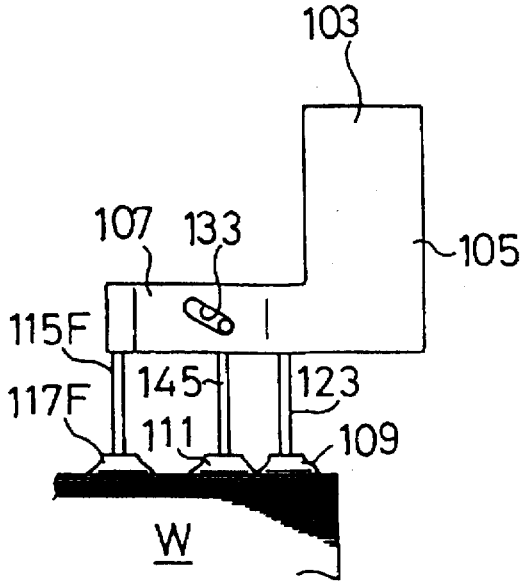

As shown in FIGS. 15A and 15B, when the loading unit 103 is lowered, the push vacuum pad 109, the take-up corner vacuum pad 111 and the vacuum pads 117A to 117F can suck the uppermost plate W of the stacked plates W.

Figure 16A:
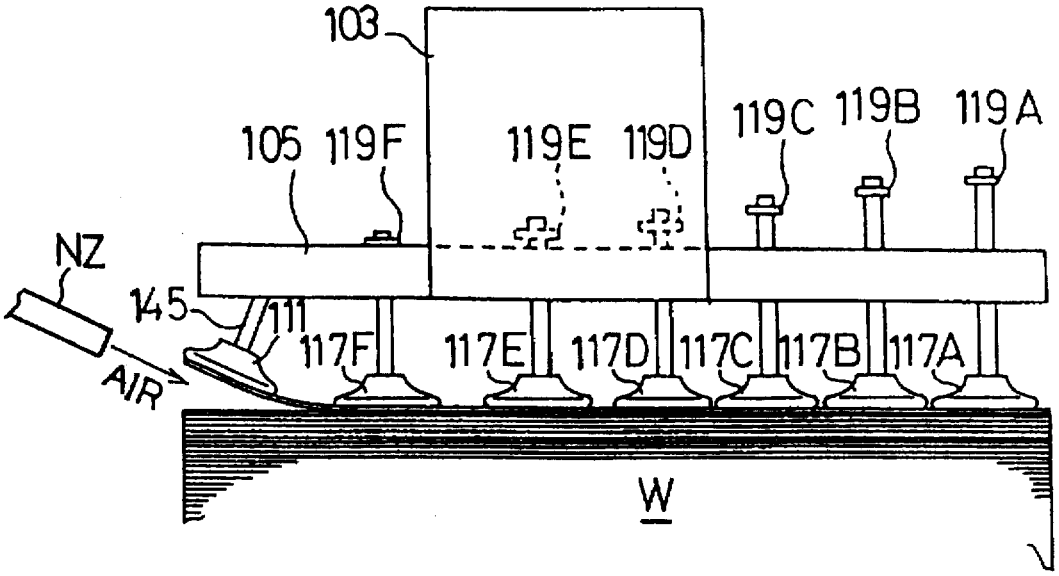
FIGS. 16A and 16B are similar front and side views for assistance in explaining the operation of the second embodiment of the plate material separating apparatus.
Figure 16B:
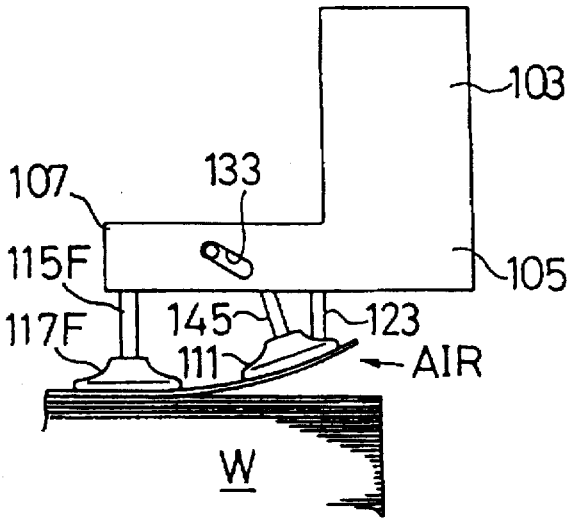

After that, when the hydraulic cylinder 141 is actuated to retract the piston rod 143, under the condition that the uppermost plate W is kept depressed by the push vacuum pad 109 of the take-up vacuum pad unit 113 (to prevent the plate W from being shifted), the left end surface of the uppermost plate W is taken up by the take-up corner vacuum pad 111 of the take-up vacuum pad unit 13. Under the conditions that the end portion of the plate W is separated as shown in FIGS. 16A and 16B, air is injected to between the uppermost plate W and the second plate W from a nozzle 100 to supply air between the two, so that the uppermost plate W can be separated more easily.

Figure 17A:
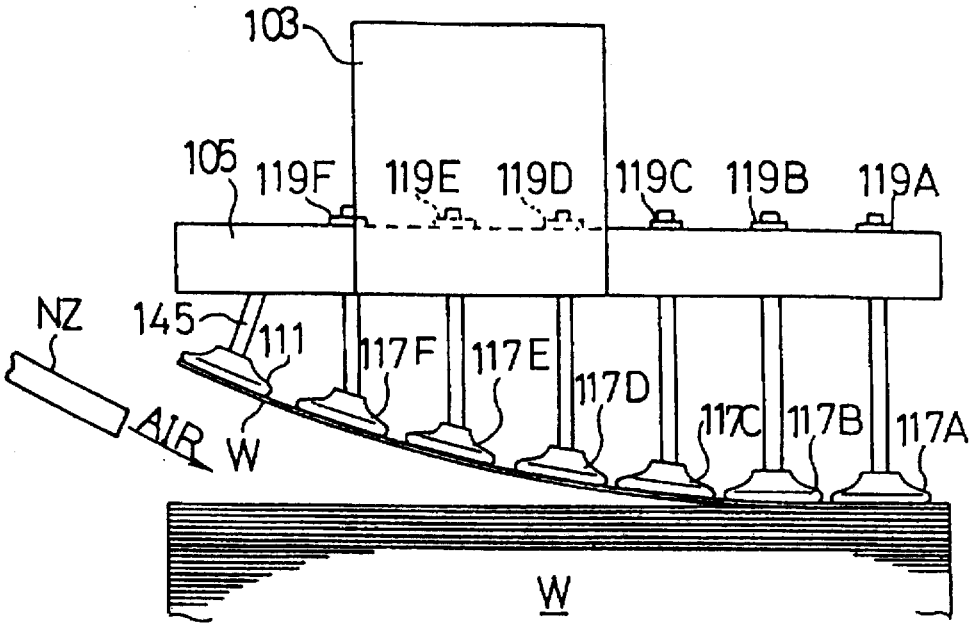
FIGS. 17A and 17B are similar front and side views for assistance in explaining the operation of the second embodiment of the plate material separating apparatus.
Figure 17B:
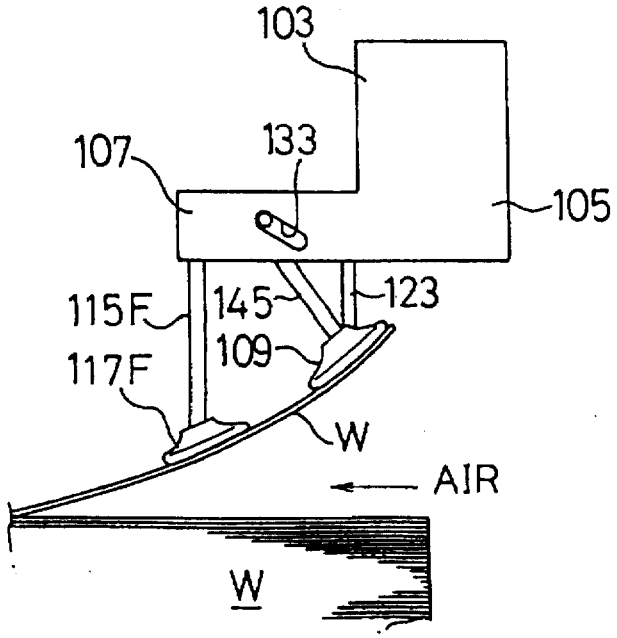

Further, as shown in FIGS. 17A and 17B, when the hydraulic cylinder 141 is further retracted, the uppermost plate W is further taken up by the take-up corner vacuum pad 111. At the same time, the loading unit 103 is lifted, until the upper end surface of the stretch member 103 are brought into contact with the respective shaft stoppers 119A to 119F attached to the upper portions of the pad shafts 115A to 115F, respectively. Under these conditions, the uppermost plate W is lifted obliquely. In addition, since air is kept injected from the nozzle 100 to between the uppermost plate W and the second plate W, it is possible to separate only the uppermost plate W from the second plate W more securely. The lifted plate W is further conveyed to the succeeding process by moving the loading unit 103 in the rightward direction in FIG. 13B, for instance.

Further, when it is not preferable to convey the plate W to the succeeding process in the oblique state, it is also possible to keep the lifted plate W horizontally. In this case, as already explained in the first embodiment an air or hydraulic cylinder is provided to lift each pad shaft 115A to 115F by an appropriate stroke and stop the pad shaft 115A to 115F at an appropriate position.

By repeating the above-mentioned plate lifting operations, the plate W can be lifted one by one and then conveyed to the succeeding machine in sequence. Further, it is preferable that the stacked plates W are mounted on an appropriate work table (not shown) moved up and down by an appropriate lifter. That is, whenever the uppermost plate W is lifted by the separating apparatus of the present invention, the work table is lifted by a distance corresponding to the thickness of the plate W. In this case, since the height position of the uppermost plate W is kept always constant, the lower position of the loading unit 103 is determined constant, so that it is possible to simplify the vertical motion of the loading unit 103.

In the above-mentioned second embodiment, since the pivotal take-up vacuum pad unit 113 is provided with the push vacuum pad 109 and the take-up corner vacuum pad 111 and further the take-up vacuum pad unit 113 is attached to the stretch member 105 together with a plurality of support vacuum pads 117A to 117F, it is possible to separate the uppermost plate W from the stacked plates one by one securely. In particular, even if the end surface of the stacked plates W is dislocated from a base line by a distance (e.g., 10 mm) in the front and rear direction, the plate W can be separated from the stacked plates securely.

Any materials of the plates W (irrespective of iron or non-iron) can be sucked and the lifted. Further, since the plate W can be taken up at the corner of the plate W, it is possible to take up the plate at the minimum possible force.

As described above, in the plate material separating apparatus according to the present invention, since the take-up vacuum pads for sucking at least one end surface or at least one corner portion of the plate W are pivoted to take up the plate, air can easily enter or be easily jetted from a nozzle to between the uppermost plate and the second plate, so that it is possible to separate the uppermost plate more securely.

What is claimed is:

1. A plate material workpiece separating apparatus, comprising:

vacuum hanger members extending horizontally;

a plurality of manipulating devices mounted on said vacuum hanger members;

a plurality of vacuum pads mounted on said manipulating devices respectively;

said plurality of manipulating devices having a first device and second devices, said first device comprising one of said plurality of manipulating devices and being disposed near to an edge of the workpiece, said first device holding said vacuum pad inclined with respect to stacked workpieces, and making said vacuum pad move up and down with respect to said vacuum hanger member;

wherein one of said second devices pushes said vacuum pad against said workpieces while said first device is holding said vacuum pad inclined with respect to stacked workpieces, and making said vacuum pad move up and down with respect to said vacuum hanger member.

2. A plate material workpiece separating apparatus, comprising:

vacuum hanger members extending horizontally;

a plurality of manipulating devices mounted independently each other on said vacuum hanger members;

a plurality of vacuum pads mounted on said manipulating devices respectively;

said plurality of manipulating devices having a first device and second devices, said first device comprising one of said plurality of manipulating devices and being disposed near to an edge of the workpiece, said first device holding said vacuum pad inclined with respect to stacked workpieces, and making said vacuum pad move up and down with respect to said vacuum hanger member;

means for positioning said vacuum pads in such a way that vertical positions of said respective vacuum pads are lowered stepwise in sequence beginning from said vacuum pad held inclined with respect to stacked workpieces and made to move up and down with respect to said vacuum hanger member, when said vacuum pads is moving upwardly.

* * * * *